United States Patent [19]

Smith

[11] Patent Number: 4,567,845

[45] Date of Patent: Feb. 4, 1986

[54] CONVERTIBLE BOAT

[75] Inventor: Delbert G. Smith, Little Falls, Minn.

[73] Assignee: Nordic Boat Company, Inc., Little Falls, Minn.

[21] Appl. No.: 637,869

[22] Filed: Aug. 6, 1984

[51] Int. Cl.[4] ..... B63B 35/00

[52] U.S. Cl. ..... 114/363; 114/364; 114/343

[58] Field of Search ..... 114/343, 354, 363, 364, 114/85, 255, 188, 71, 189; 441/125, 126, 127

[56] References Cited

U.S. PATENT DOCUMENTS

| | | | |
|---|---|---|---|
| 3,039,417 | 6/1962 | Hoffberg | 114/71 |
| 3,394,417 | 7/1968 | O'Link | 114/363 |
| 3,475,773 | 11/1969 | Codman | 114/363 |
| 3,634,897 | 1/1972 | Cuccio | 114/343 |
| 4,234,989 | 11/1980 | Pearcy | 114/363 |
| 4,278,289 | 7/1981 | Esposito | 114/363 |
| 4,425,861 | 1/1984 | Raikamo | 114/71 |
| 4,442,787 | 4/1984 | Curran | 114/363 |

*Primary Examiner*—Trygve M. Blix
*Assistant Examiner*—C. T. Bartz
*Attorney, Agent, or Firm*—Barnes Kisselle Raisch Choate Whittemore & Hulbert

[57] ABSTRACT

A pleasure boat has a conventional open cockpit with seats along its opposite sides. The floor of the cockpit has a socket therein for supporting an elevated pedestal seat. The seats are swingable upwardly toward each other to form an elevated platform for the pedestal seat.

9 Claims, 7 Drawing Figures

CONVERTIBLE BOAT

This invention relates to a pleasure boat convertible into a fishing boat.

One type of inboard or outboard pleasure boat has an open cockpit with seats along opposite sides thereof. Such an arrangement is ideal for a pleasure craft, but is not entirely suitable as a fishing boat because the seats are too low to provide the convenience and maneuverability required for fishing. On the other hand, a fishing boat, particularly a bass fishing boat, has one or more elevated pedestal seats which render the boat unsuitable as a pleasure craft.

The object of this invention is to enhance the versatility of pleasure boats by making them easily adaptable for use in sportfishing; such conversion capable of being performed quickly by one person; the boat, in either the pleasure boating or fishing configuration, being free from any protruding hardware which might cause injury to persons or restrict their movement and being generally pleasing to the eye.

In general, the boat has an open cockpit with seats along its opposite sides arranged to be pivoted upwardly and inwardly toward each other to form an elevated platform extending across the cockpit. A removable upright column extends through the platform to provide an elevated pedestal seat.

Other objects, features and advantages of the present invention will become apparent from the following description and accompanying drawings, in which.

Figure 1:
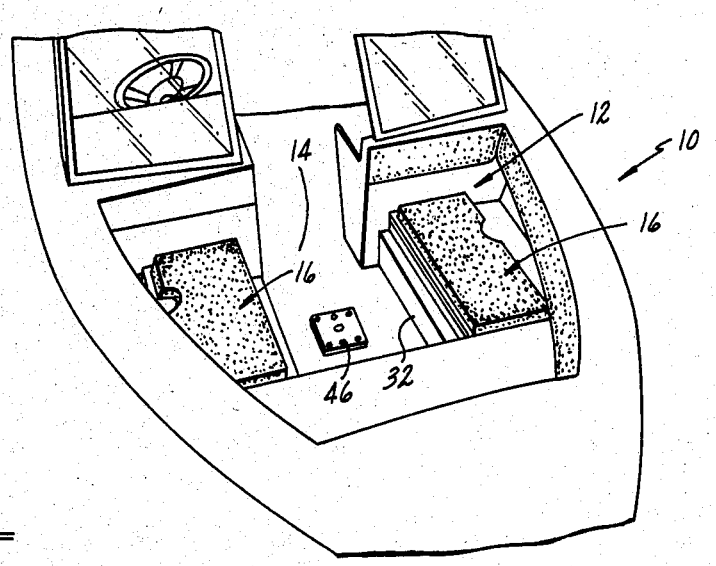
FIG. 1 is a fragmentary perspective view of the bow of the boat embodying this invention (shown in passenger seating configuration)
Figure 2:
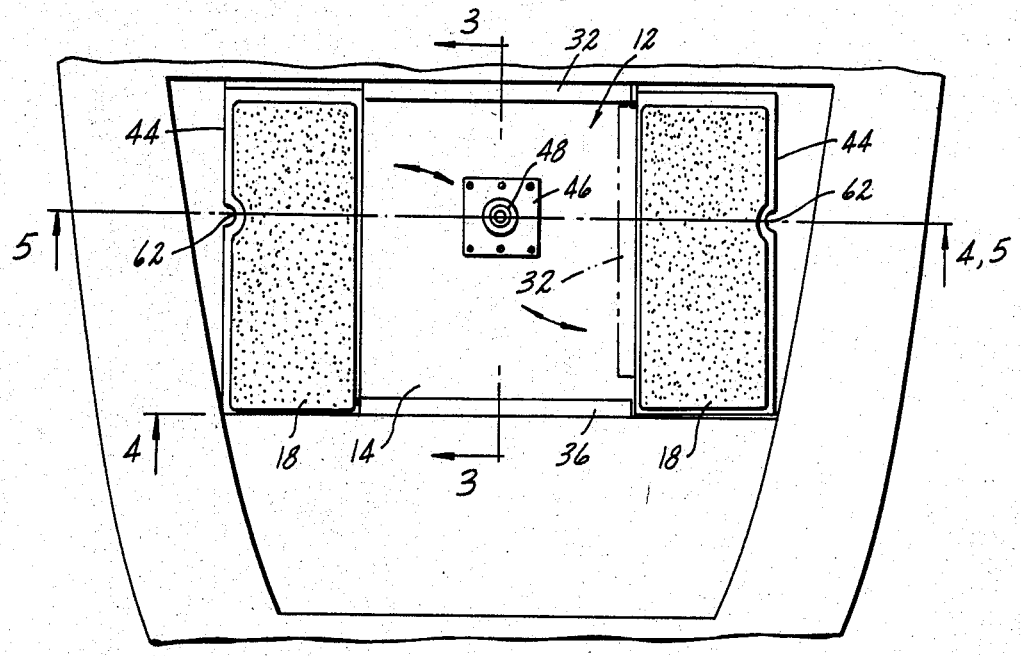
FIG. 2 is a fragmentary plan view of the boat in passenger seating configuration.
Figure 3:
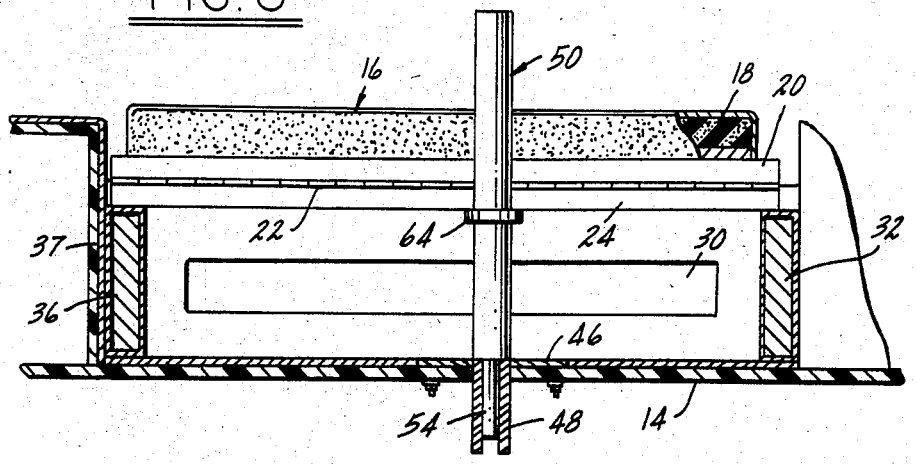
FIG. 3 is a sectional view along the line 3—3 in FIG. 2 with the pedestal seat column in place.
Figure 4:
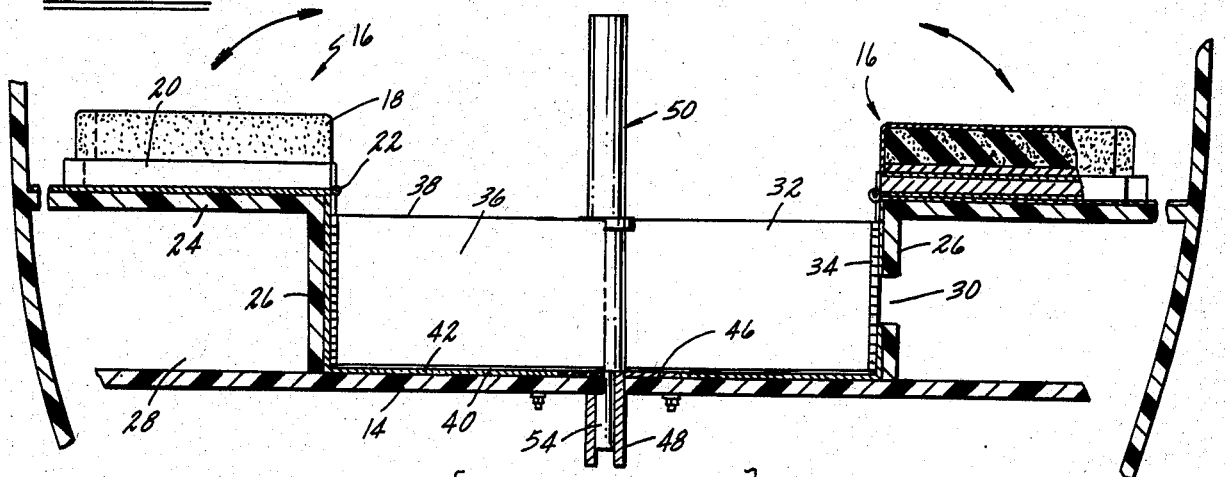
FIG. 4 is a sectional view along line 4—4 in FIG. 2.

In FIG. 1 there is illustrated a pleasure boat 10 having a somewhat conventional cockpit 12 at the bow portion thereof. The cockpit 12 has a floor panel 14 and at each side of the cockpit there are arranged seats 16. As shown in FIG. 4, each seat 16 comprises a seat cushion 18 attached to a rigid seat panel 20. The opposed inner edges of seat panels 20 are hinged as at 22 to horizontally extending seat bases 24 which cooperate with upright bulkheads 26 to form a storage compartment 28 under each seat. The storage compartments 28 are accessible through elongated openings 30 in bulkheads 26, one of which is normally closed by vertical closure panel 32. The panel 32 has its vertical rear edge hinged as at 34 (FIG. 2) to its associated bulkhead 26. Closure panel 32 is adapted to be swung from the broken to the solid line positions shown in FIG. 2. An upright support panel 36 is permanently attached to a forward bulkhead 37 (FIG. 3).

The upper edges 38 of panels 32,36 are spaced below the top face of seat bases 24 a distance corresponding to the thickness of the seat panels 20. The lower edge 40 of panel 32 is substantially flush with the pad or carpeting 42, if any, on the floor panel 14. The length of panels 32,36 is generally equal to the distance between the two upright bulkheads 26.

Figure 5:
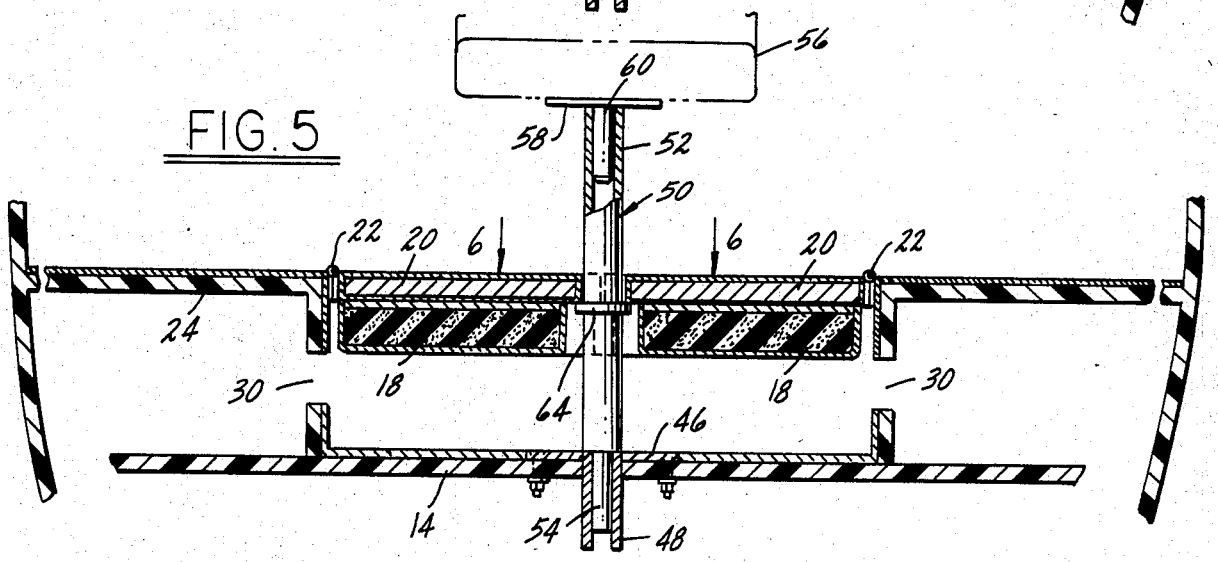
FIG. 5 is a sectional view along line 5—5 in FIG. 2 showing the seats arranged in the fishing boat configuration.
Figure 6:
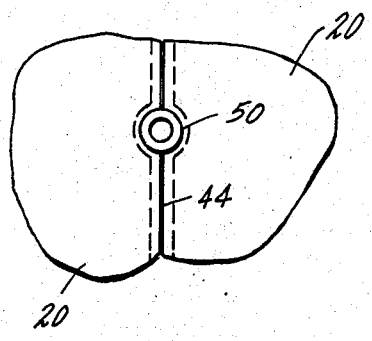
FIG. 6 is a fragmentary top plan view of the platform and pedestal post connection.
Figure 7:
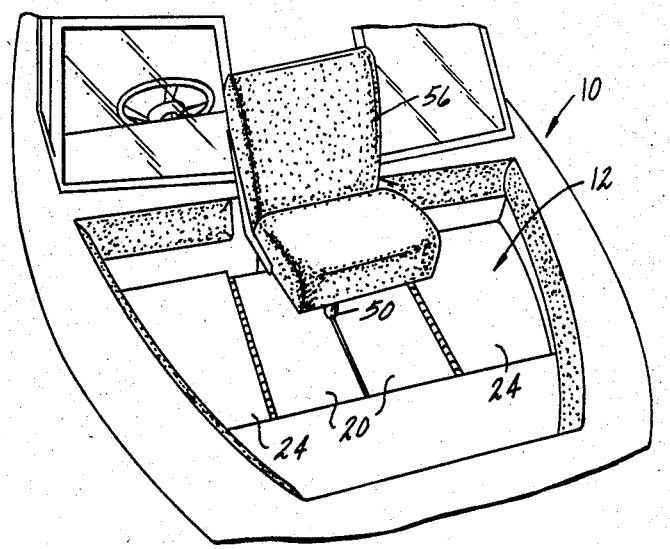
FIG. 7 is a fragmentary perspective view of the bow of a boat embodying this invention in the fishing boat configuration.

Although each seat base 24 is curved along its laterally outer edge to conform with the curvature of the outer sides of the boat, the laterally outer edge 44 of each seat panel 20 is generally straight and parallel to the hinge 22. Each seat panel 20 is generally rectangular in shape. The width of each seat panel 20 is equal to approximately half the distance between the two upright bulkheads 26. The opposite end edges and the laterally outer edges of cushions 18 are offset slightly from the corresponding edges of seat panels 20. With the hinged panel 32 swung to the position shown in solid lines in FIG. 2 the two seats 16 are adapted to be swung upwardly about their hinges toward each other from the position shown in FIG. 4 to the position shown in FIG. 5. In the latter position the faces of seat panels 20 opposite cushions 18 are substantially flush with the top faces of the seat bases 24 and cooperate therewith to form a continuous horizontal platform across the entire cockpit area. The opposite end edge portions of panels 20 are horizontally supported on the upper edges of panels 32,36.

At generally the central portion of the floor panel 14 there is mounted a rigid base plate 46 having a downwardly projecting sleeve 48 extending through floor panel 14. Base plate 46 and sleeve 48, which are rigidly secured together, provide a support for an upright seat pedestal 50. Pedestal 50 comprises a rigid tube 52 having a shaft extension 54 secured to the lower end thereof. Shaft 54 is dimensioned to have a close fit within sleeve 48 and is of sufficient length to provide lateral stability to pedestal 50. A seat 56 has a base plate 58 secured to the bottom thereof. A shaft 60 adapted to be received within the upper end of tube 52 is welded or otherwise rigidly secured to base plate 58. Each cushion 18 and seat panel 20 has a semi-circular indentation 62 adapted to fit around pedestal 50 when they are swung to the position shown in FIG. 5. At the indentations 62 the seat panels 20 are horizontally supported on pedestal 50 which extends upwardly therethrough by engaging a support ring 64 on tube 52. The fore and aft edge portions of seat panels 20 are supported on the upper edges of the panels 32,36. The inverted seat panels 20 thus provide a rigid support platform when the boat is converted from a pleasure to a fishing craft.

I claim:

1. A boat having an open cockpit, said cockpit having a bottom floor panel and a pair of seats laterally spaced apart and on generally opposite sides of the cockpit, each seat comprising a generally horizontal support panel disposed at a level above the floor panel and a generally flat seat panel supported in overlying relation on said support panel to form the seat, said floor panel having a pedestal support mounted thereon at a location generally midway between the opposed seats, a seat pedestal comprising a column adapted to be removably engaged with said pedestal support, said column having a length so as to extend upwardly above the level of the support panel of each seat when engaged with said pedestal support, said seat panels being constructed and arranged to be movable from said position overlying the support panels to a horizontally disposed position generally inwardly of and generally flush with said support panels and extending therebetween to form therewith a horizontal support platform extending continuously between the opposed inner edges of and encompassing the support panels, and the juxtaposed edges of said seat panels when moved to said platform-forming position having recesses therein to accommodate the column extending upwardly therethrough.

2. A boat as called for in claim 1 wherein each seat panel has a cushion on the upper face thereof, said seat panels being invertible when moved to the platform-forming position so that the normally under side of the seat panels form the top face of the platform.

3. A boat as called for in claim 1 wherein the opposed inner edges of the two seat panels are hinged to the opposed inner edges of the two horizontal support panels so that the seat panels can be moved to said platform-forming position by swinging them upwardly and toward each other about the hinged edges thereof.

4. A boat as called for in claim 3 including means for horizontally supporting the opposite end portions of the seat panels when swung to said platform-forming position.

5. A boat as called for in claim 4 wherein said horizontal support means comprise at least one horizontally extending member swingable about a fixed vertical axis from a position extending adjacent one of the seats to a position extending transversely between the seats.

6. A boat as called for in claim 3 wherein each seat panel has a seat cushion fixedly secured to the upper face thereof, a pair of supports adapted to be positioned so as to extend between the seats adjacent the opposite ends thereof, the opposite ends of each seat cushion being recessed inwardly from the adjacent opposite ends of the seat panels so that, when the seat panels are swung to said platform-forming position, the opposite end portions of the seat panels overlying and are horizontally supported by said support members.

7. A boat as called for in claim 6 wherein the opposed inner edges of the support panels are spaced apart in parallel relation and said seat panels are of rectangular shape.

8. A boat as called for in claim 1 wherein said column is formed with an enlargement which, when the pedestal is engaged with said pedestal support, is constructed and arranged to engage and support the seat panels intermediate their opposite ends when in the platform-forming position.

9. A boat as called for in claim 1 wherein the cockpit is located adjacent the bow of the boat.

* * * * *